United States Patent [19]

Väyrynen

[11] 4,077,784

[45] Mar. 7, 1978

[54] ELECTRIC FILTER

[76] Inventor: Lauri Väyrynen, Saaristonkatu 53 A 1, 92100 Raahe, Finland

[21] Appl. No.: 617,816

[22] Filed: Sep. 29, 1975

[30] Foreign Application Priority Data

Feb. 10, 1974 Finland ..... 2880/74

[51] Int. Cl.[2] ..... B03C 3/45

[52] U.S. Cl. ..... 55/146; 55/155; 55/417; 55/DIG. 33; 131/187; 131/262 R; 128/142.6

[58] Field of Search ..... 55/123, 124, 130, 131, 55/132, 146, 155, 417, 489, 510, 524, DIG. 33, DIG. 35, 156, 498, 441, 154; 131/187, 262 R, 262 B; 128/142.6

[56] References Cited

U.S. PATENT DOCUMENTS

| | | | |
|---|---|---|---|
| 2,868,319 | 1/1959 | Rivers | 55/132 |
| 2,974,747 | 3/1961 | Coolidge, Jr. et al. | 55/130 |
| 3,757,802 | 9/1973 | Streule et al. | 131/187 |
| 3,807,144 | 4/1974 | Graybill | 55/510 |

FOREIGN PATENT DOCUMENTS

| | | | |
|---|---|---|---|
| 136,134 | 2/1950 | Australia | 55/154 |
| 814,835 | 9/1951 | Germany | 55/417 |
| 292,479 | 6/1929 | United Kingdom | 55/124 |

*Primary Examiner*—Frank W. Lutter
*Assistant Examiner*—David L. Lacey
*Attorney, Agent, or Firm*—Gifford, Chandler, Sheridan & Sprinkle

[57] ABSTRACT

An electric filter for separating impurities from air including a housing which contains separator plates disposed in spaced relationship and formed of conductive material and alternate ones of said plates are connected to opposite poles of a source of voltage.

5 Claims, 4 Drawing Figures

FIG. 1
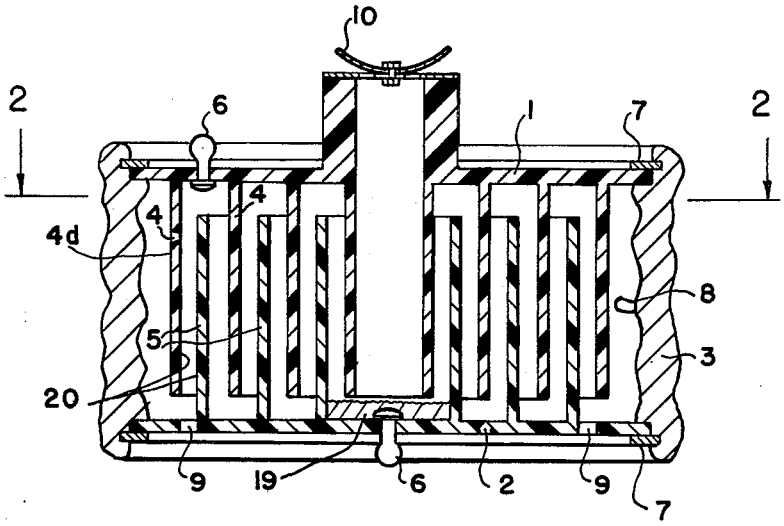
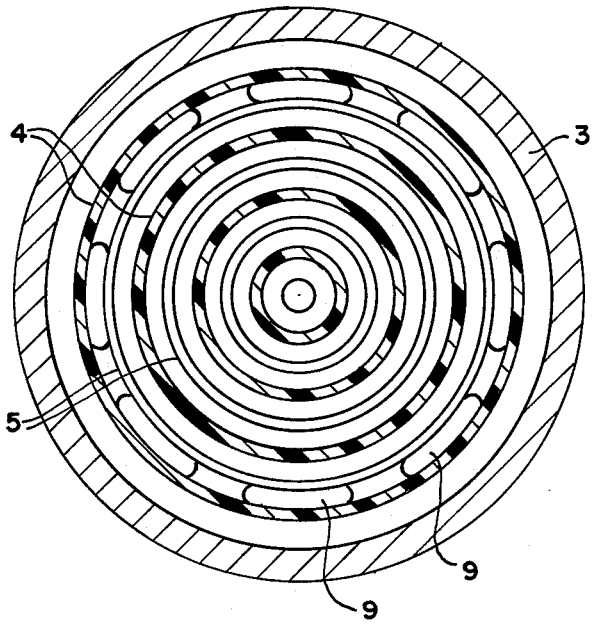
FIG. 2

ELECTRIC FILTER

BACKGROUND OF THE INVENTION

I. Field of the Invention

The present invention relates to an electric filter for filtering impurities from air, the filter comprising a housing which contains filter plates located in spaced relationship between each other and made of some conductive material and which are alternately connected to opposite poles of the source of voltage.

II. Description of the Prior Art

The above type of electric filter intended to be used primarily in connection with gas masks is previously known on the basis of, e.g. U.S. Pat. No. 2,974,747. However, this known filter is complicated and expensive as to its construction and, moreover, it is poorly insulated.

SUMMARY OF THE INVENTION

An object of the invention is to provide an improved electric filter of the above-mentioned type with simple construction and which is inexpensive and electrically well insulated.

Another object of the invention is to provide an electric filter which is sufficiently inexpensive and provided with such construction that it can be used as cigarette filter.

These objects will be accomplished on the basis of the features of the invention primarily defined in the accompanying claims.

DESCRIPTION OF THE DRAWINGS

The invention will be described hereinafter in more detail with reference to the accompanying drawings, wherein:

FIG. 1 shows one embodiment of the filter according to the invention in vertical section.

FIG. 2 is section taken along the line II—II in FIG. 1.

DESCRIPTION OF SEVERAL PREFERRED EMBODIMENTS OF THE INVENTION

Figure 3:
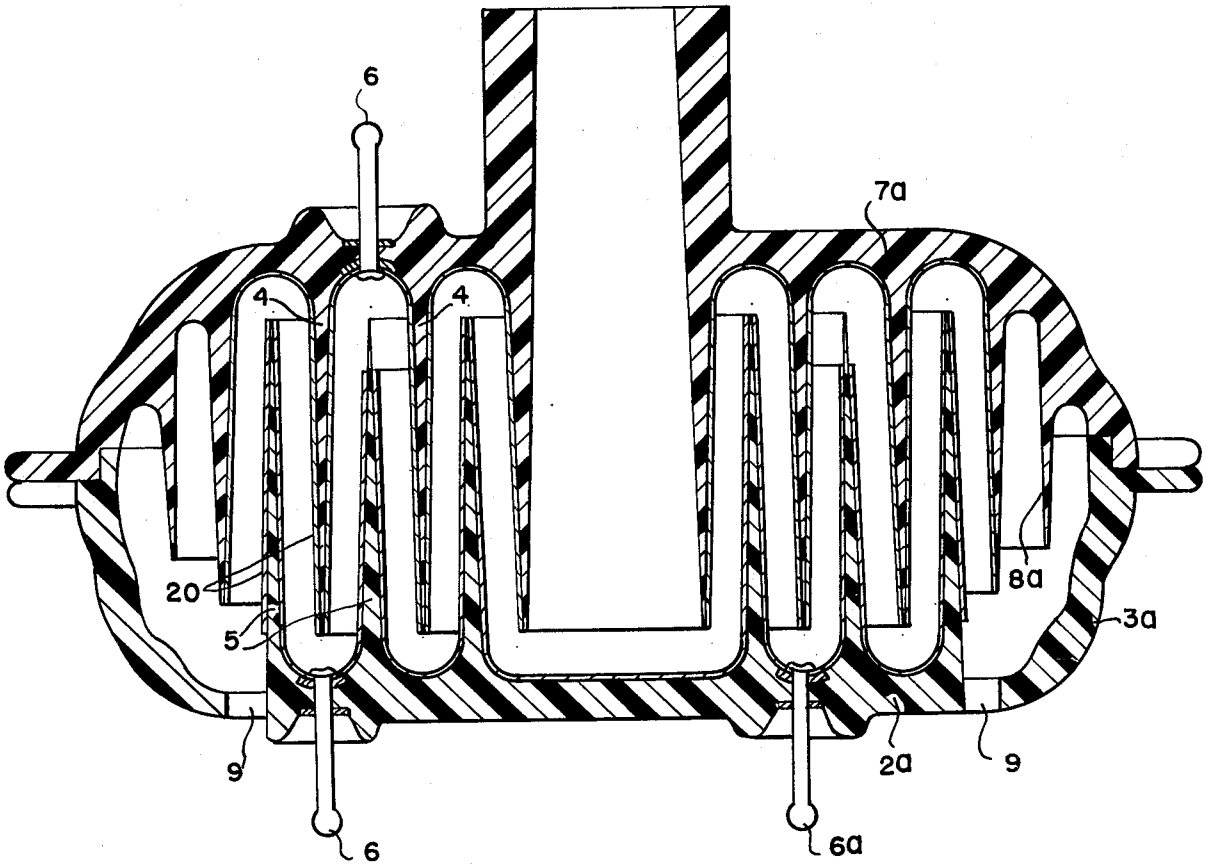
FIG. 3 illustrates an electric filter according to a second embodiment of the invention in vertical section.

The filter according to FIG. 1 consists of three main parts, namely housing members 1 and 2 and insulation ring 3. Cylindrical tubular separator plates 4 extend from the housing member 1 and cylindrical tubular or separator plates 5 extend in the same manner from the housing member 2, the plates 5 placing themselves in between the plates 4. Each housing member with its separator plates is preferably made as an integral plastic pressing. The surfaces of the plates 4 and 5 are coated with a conductive material 20, e.g. metal or carbon membrane or the like. The inner or facing surfaces of the housing members are also coated the same way on their inner surfaces between the separator plates. Both housing members are provided with conductor pins 6 which provide electrical contact with the conductive material. The conductor pins 6 are circular in transverse section and thus they permit the rotation of the source of voltage while at the same time maintaining electrical contact.

The housing members 1 and 2 are secured at their edges to the insulation ring 3 and are locked removably in place by means of the snap rings 7. By pressing the snap rings 7 out of the grooves of the insulation ring 3, the housing members can be detached and the filter cleaned. The insulation ring 3 holds the housing members 1 and 2 at such a distance from each other that there remain suitable slots for an air stream between the free ends of the separator plates 4 and 5 and the inner surface of the opposed housing member.

The voltage for the source of current is e.g. approximately 2000 volts, the current being restricted to a few tenths of a milliampere. The power of the source of current is thus restricted to be sufficiently small so as not to be dangerous to a man. As far as the function of the device is concerned, however, the essential point is the electrical insulation which should be as good as possible. Dirt and impurities accumulating on the insulation surfaces easily constitute a passageway to leak current. In order to eliminate leak current the inner surface of the insulation ring 3 is provided with grooves 8 which extend around in the peripheral direction and which are sine-shaped in transverse section. For the same purpose the outer surface of the radially outermost separator plate 4 is not coated with electrically conductive material. Air inlets 9 are located near the outer periphery of the housing member 2, but inside the radially outermost separator plate **4*d***, whereby the impurities in the incoming air cannot deposit on the insulation surfaces and decrease their leak resistance to leak current.

When using the filter in connection with gas masks there is the possibility of some humidity condensating from exhalation air between the separator plates 4 and 5. In order to prevent this from happening the filter is provided with a flap valve 10 at its outlet which permits flow in just one direction.

The separating properties of the filter can be made more complete by means of certain amount of activated carbon 19 being placed within the innermost insulation cylinder.

FIG. 3 shows an embodiment which can be made of two housing members **1*a* and 2*a* as a plastic pressing. The edges of the housing members 1*a* and 2*a* can be secured to each other and thus form an insulation ring 3*a* closing the sides of the filter. For increasing the resistance to leak current the outermost separator plate 8*a* is uncoated with an electrically conductive material. In addition to the direct-current connecting poles 6, alternating voltage can be fed to a part of the filter through the connecting pole 6*a*. Due to the manufacturing technique the shape of the separator plates is wedge-like and tapering, whereby both housing members can be manufactured by using die casting technique between two mold halves. Otherwise the filter corresponds to that illustrated in FIG. 1**.

Figure 4:
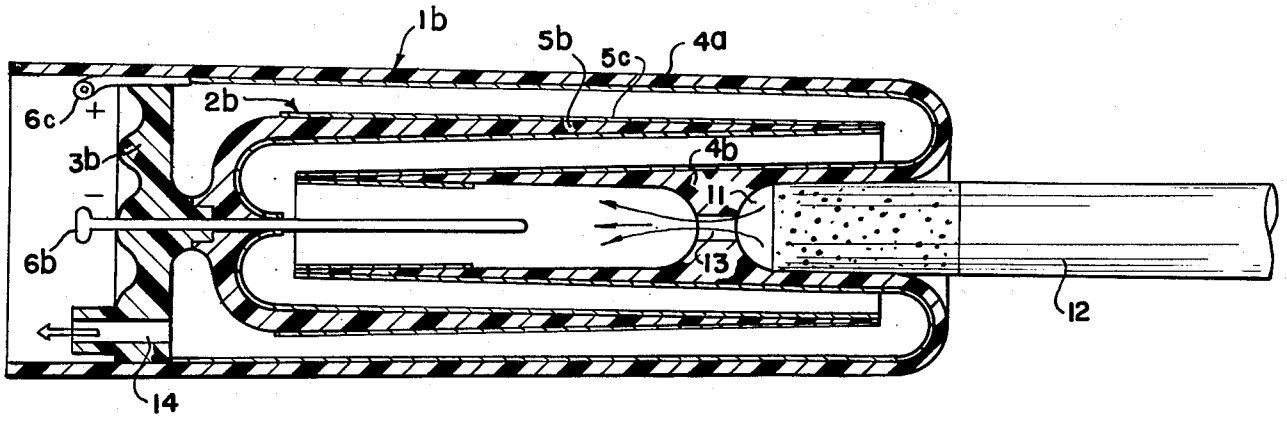
FIG. 4 illustrates an electric filter according to a third embodiment of the invention in vertical section.

FIG. 4 shows a special embodiment of the invention, i.e. a cigarette filter. At one of its ends there is a recess 11 for the cigarette 12. In this case, also, the filter consists of two housing members, one of them being the housing member **1*b* which forms the outermost separator plate 4*a* and the innermost separator plate 4*b*, and the other housing member being 2*b* which forms the intermediate insulation ring 3*b* between the filter halves, the separator plate 5*b* which is secured to the insulation ring 3*b* extending in between said separator plates 4*a* and 4*b*. The negative voltage pole 6*b* extending through the insulation ring 3*b* reaches within the separator plate 4*b*. The smoke from the cigarette 12 passes into the device through the inlet 13. From there smoke must make its winding way within the intermediate spaces between the separator plates 4***b* and 5*b* until it escapes through the outlet 14. A conductive mass preferably comprising a sticky, oil-like mass shown at 5*c* which effectively binds impurity particles hitting it is provided on the exposed surfaces of the filter cylinder. In addition, such conductive coating should have high resistivity to electricity. Such mass can be prepared e.g. by mixing activated carbon powder with suitable binders.

Having thus described my invention, I claim:

1. An electric filter for separating impurities from air comprising:

a first housing member and a second housing member constructed of an electrical insulating material;

at least one tubular electrostatic separator plate integrally secured at one axial end to a first side of each of said housing members, said separator plates being constructed of an electrical insulating material;

insulating means securing said housing members together in a spaced relationship so that the first sides of the housing members face each other and so that the separator plates are coaxial and radially spaced from each other thereby forming an air passage between the separator plates;

air inlet means formed in the first housing member and air outlet means formed in the second housing member;

an electrically conductive coating formed on said separator plates and on the first side of each housing member; and means for connecting the electrically conductive coatings on the two housing members to opposite poles of a source of electrical energy.

2. The electric filter as defined in claim 1 and in which the outer radial surface of the radially outermost separator plate is not coated with the electrically conductive material.

3. The electric filter as defined in claim 1 and in which said insulating means comprises a tubular insulating member constructed of electrically insulating material and disposed axially between said housing members and around the outer periphery of the housing members.

4. The electric filter as defined in claim 3 and in which said insulating member is provided with an interior surface, said surface being provided with a plurality of grooves.

5. The electric filter as defined in claim 1 and including a check valve disposed in said outlet means to permit gas flow only in the direction from said inlet means to said outlet means.

* * * * *